US008637810B2

(12) United States Patent
Mukaibatake et al.

(10) Patent No.: US 8,637,810 B2
(45) Date of Patent: Jan. 28, 2014

(54) ATMOSPHERIC PRESSURE IONIZATION MASS SPECTROMETER

(75) Inventors: Kazuo Mukaibatake, Kyoto (JP); Daisuke Okumura, Kyoto (JP)

(73) Assignee: Shimadzu Corporation, Kyoto-Shi (JP)

( * ) Notice: Subject to any disclaimer, the term of this patent is extended or adjusted under 35 U.S.C. 154(b) by 0 days.

(21) Appl. No.: 13/806,680

(22) PCT Filed: Jun. 24, 2010

(86) PCT No.: PCT/JP2010/060708

§ 371 (c)(1),
(2), (4) Date: Dec. 21, 2012

(87) PCT Pub. No.: WO2011/161788

PCT Pub. Date: Dec. 29, 2011

(65) Prior Publication Data

US 2013/0092835 A1 Apr. 18, 2013

(51) Int. Cl.
*H01J 49/42* (2006.01)

(52) U.S. Cl.
CPC ..... *H01J 49/42* (2013.01)
USPC ..... 250/281; 250/288

(58) Field of Classification Search
USPC ..... 250/281, 282, 288, 290, 292
See application file for complete search history.

(56) References Cited

U.S. PATENT DOCUMENTS

| | | | | |
|---|---|---|---|---|
| 4,023,398 | A * | 5/1977 | French et al. | 73/23.2 |
| 4,647,772 | A * | 3/1987 | Lewis et al. | 250/288 |
| 2008/0308721 | A1 | 12/2008 | Senko et al. | 250/281 |

FOREIGN PATENT DOCUMENTS

| | | |
|---|---|---|
| JP | 10-012188 | 1/1998 |
| JP | 2000-149865 | 5/2000 |
| JP | 2001-101992 | 4/2001 |
| JP | 2001-351563 | 12/2001 |
| JP | 2009-129868 | 6/2009 |
| WO | WO 2008/157019 A2 | 12/2008 |

OTHER PUBLICATIONS

Japanese language international preliminary report on patentability dated Jan. 15, 2013 and its English language translation issued in corresponding PCT application PCT/JP2010/060708.

* cited by examiner

*Primary Examiner* — Kiet T Nguyen

(74) *Attorney, Agent, or Firm* — Bingham McCutchen LLP

(57) ABSTRACT

In a first-stage intermediate vacuum chamber, cluster ions causing a background noise are dominantly formed in area (A), while fragment ions are dominantly generated in area (B). Taking this fact into account, in an in-source CID analysis mode, a DC voltage higher than that applied to a skimmer is applied to a first ion guide so as to create an accelerating electric field in area (B), whereby the ions are sufficiently energized to promote the fragmentation. When the in-source CID is not performed, a DC voltage higher than that applied to the first ion guide is applied to the exit end of a desolvation tube so as to create an accelerating electric field only in area (A) without creating such a field in area (B), whereby both the formation of the cluster ions and the generation of the fragment ions are suppressed, so that a high-quality chromatogram can be obtained.

7 Claims, 5 Drawing Sheets

0V

0V
-100V

0V
-60V 1
3
3b
A
6
7
B
8
3a
8a
C
VDL
21
VQDC
22
0V
23
DESOLVATION TUBE POWER SUPPLY
ION GUIDE POWER SUPPLY
SKIMMER POWER SUPPLY
CONTROLLER
20

Fig. 3A $V_{DL}/V_{QDC}$ = 0/0[V]
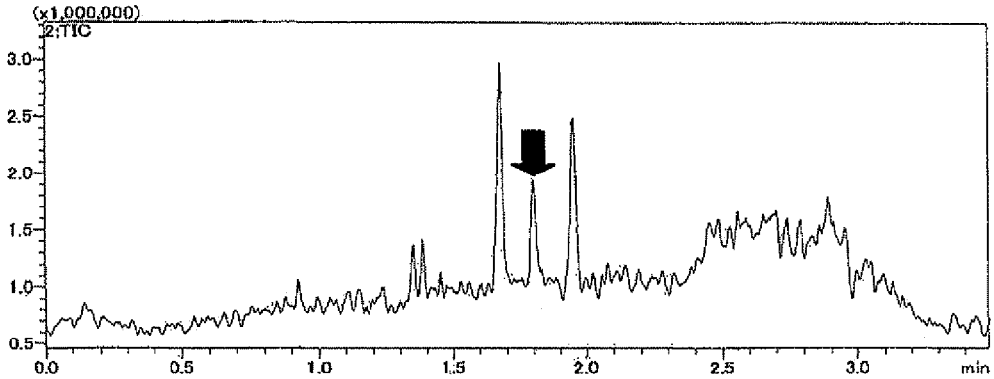
Fig. 3B $V_{DL}/V_{QDC}$ = -100/0[V]
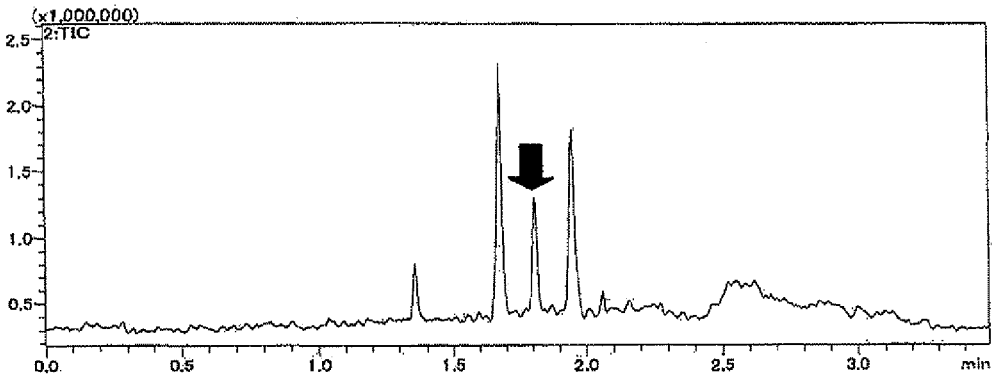
Fig. 3C $V_{DL}/V_{QDC}$ = -60/-60[V]
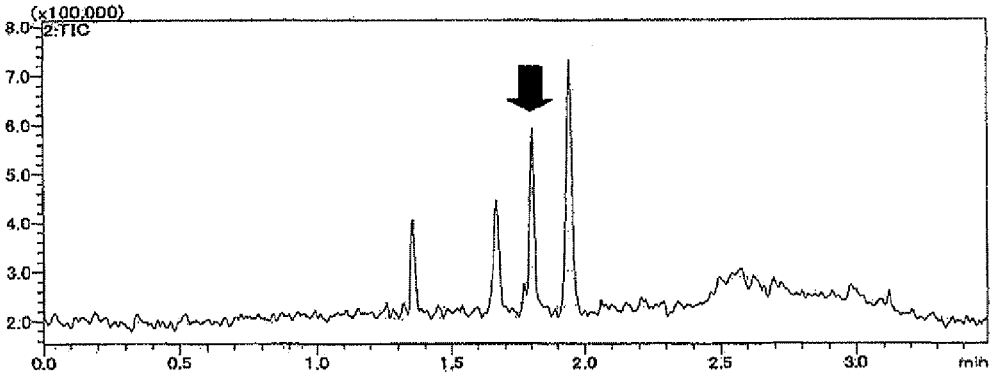

Fig. 4A $V_{DL}/V_{QDC}$ = 0/0[V]
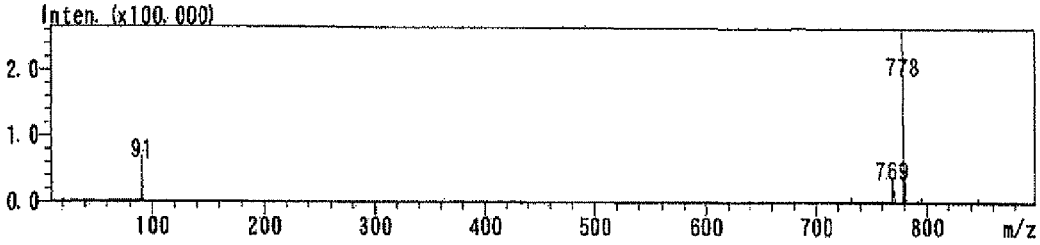
Fig. 4B $V_{DL}/V_{QDC}$ = -100/0[V]
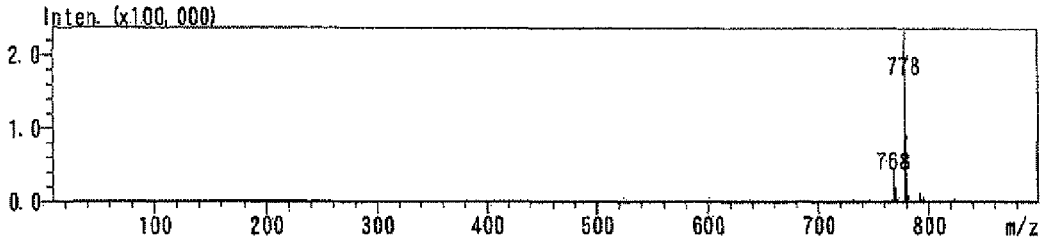
Fig. 4C $V_{DL}/V_{QDC}$ = -60/-60[V]
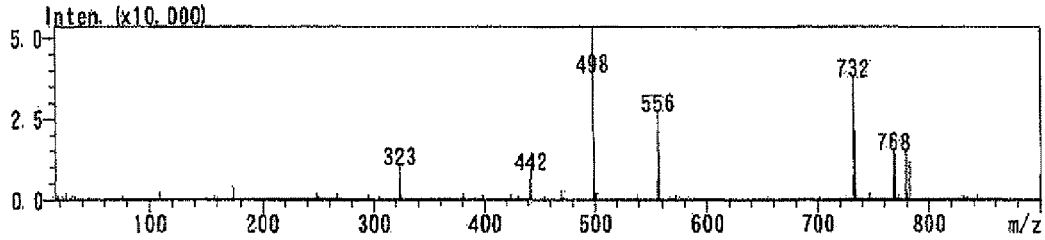

Fig. 5A $V_{DL}/V_{QDC}$ = 0/0[V]
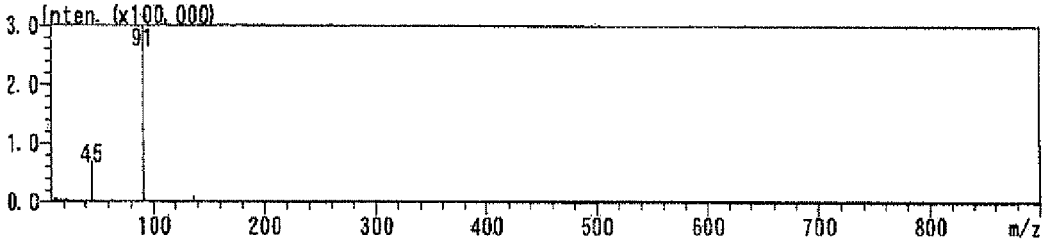
Fig. 5B $V_{DL}/V_{QDC}$ = -100/0[V]
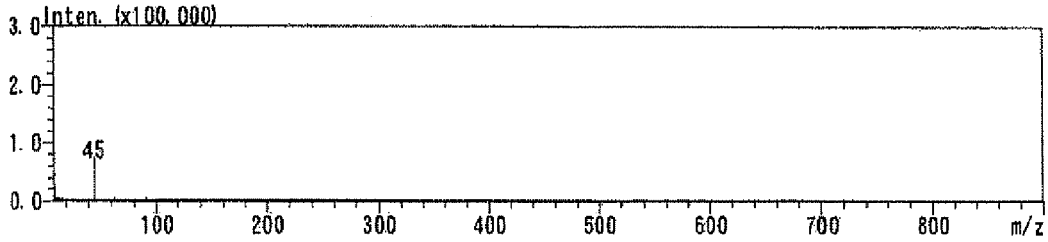
Fig. 5C $V_{DL}/V_{QDC}$ = -60/-60[V]
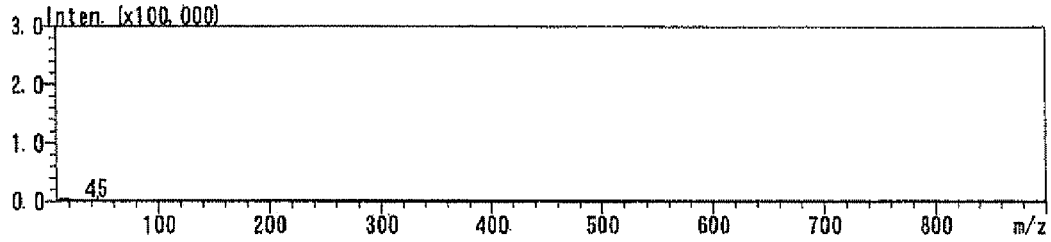

ATMOSPHERIC PRESSURE IONIZATION MASS SPECTROMETER

TECHNICAL FIELD

The present invention relates to an atmospheric pressure ionization mass spectrometer in which a liquid sample is ionized under substantially atmospheric pressure and subjected to a mass spectrometry under high vacuum, as in a liquid chromatograph mass spectrometer.

BACKGROUND ART

A liquid chromatograph mass spectrometer (LC/MS) having a liquid chromatograph (LC) and a mass spectrometer (MS) combined with each other normally includes an atmospheric pressure ion source using electrospray ionization (ESI), atmospheric pressure chemical ionization (APCI) or other methods to generate gaseous ions from a liquid sample. In an atmospheric pressure ionization mass spectrometer using an atmospheric pressure ion source, the ionization chamber in which the ions are generated is maintained at substantially atmospheric pressure, whereas the analysis chamber in which a mass separator (e.g. a quadrupole mass filter) and a detector are contained must be maintained in a high-vacuum state. To satisfy these conditions, a multi-stage differential pumping system is adopted, in which one or more intermediate vacuum chambers are provided between the ionization chamber and the analysis chamber so as to increase the degree of vacuum in a stepwise manner.

In the atmospheric pressure ionization mass spectrometer, a stream of air or gaseous solvent almost continuously flows from the ionization chamber into the intermediate vacuum chamber in the next stage. Therefore, although the intermediate vacuum chamber is maintained under vacuum atmosphere, the gas pressure in this chamber is relatively high (which is normally at approximately 100 [Pa]). One example of the system for efficiently transporting ions to the subsequent stage under such a relatively high gas pressure is an ion guide composed of a plurality of "virtual" rod electrodes arranged so as to surround an ion-beam axis, each virtual rod electrode consisting of a plurality of plate electrodes arranged at intervals in the direction of the ion axis (see Patent Documents 1-3). Such an ion guide is capable of efficiently converging ions and transporting them to the subsequent stage even under a high gas pressure, and therefore, is useful for improving the sensitivity of the mass spectrometry.

Regarding such a multi-stage differential pumping system, it is commonly known that, when ions are accelerated in the first-stage intermediate vacuum chamber, the energized ions collide with the residual gas and produce fragment ions. This function is called in-source collision induced dissociation (CID). By performing a mass spectrometry on the fragment ions generated by the in-source CID, it is possible to easily analyze the structure or other aspects of a substance.

Normally, for the in-source CID, different voltages are applied to the first and second electrodes, which are separately arranged in the traveling direction of the ions within the first-stage intermediate vacuum chamber, so as to create a direct-current potential difference between the two electrodes and accelerate the ions by the effect of an electric field having that potential difference. The efficiency of dissociating the ions in the in-source CID depends on the amount of energy given to the ions. Accordingly, in a conventional mode of in-source CID performed in an atmospheric pressure ionization mass spectrometer, the voltages applied to the electrodes are adjusted so that the intensity of an ion in question will be maximized. When the in-source CID should not be performed in the atmospheric pressure ionization mass spectrometer (i.e. when the fragment ions are unwanted), it is common that the voltages applied to the electrodes be controlled so that no acceleration of the ions occurs in the first-stage intermediate vacuum chamber.

However, this conventional system has the following problem:

When ions are introduced from the ionization chamber maintained at substantially atmospheric pressure into the first-stage intermediate vacuum chamber through a small diameter capillary and orifice or similar structure, the ions are cooled due to an adiabatic expansion. The cooled ions are more likely to be combined together due to the van der Waals force, forming a cluster ion (i.e. a mass of ions). When cluster ions are formed, unintended peaks appear on the mass spectrum, making the peak pattern of the mass spectrum complex and difficult to analyze. The adiabatic expansion also causes the ions originating from the sample to be combined with the molecules of the solvent in the mobile phase, making the peak pattern of the mass spectrum even more complex. The generation of a dimer, trimer or the like of the ions of the solvent in the mobile phase can also occur, which forms a background noise and deteriorates the quality of the chromatogram.

None of the conventional atmospheric pressure ionization mass spectrometers have barely taken into account the influence of the background noise due to the cluster ions or the like created inside the first-stage intermediate vacuum chamber in the previously described way, and no active efforts for reducing such a noise have been made thus far. This problem is particularly noticeable when the voltages applied to the electrodes are adjusted so as to maximize the intensity of the target ions for the sake of the in-source CID. Under this condition, although a high dissociating efficiency is achieved, a relatively large amount of cluster ions are often produced, which may possibly deteriorate the quality of the mass spectrum or chromatogram, making it difficult to perform a qualitative and/or structural analysis of the substance of interest.

BACKGROUND ART DOCUMENT

Patent Document

Patent Document 1: JP-A 2000-149865
Patent Document 2: JP-A 2001-101992
Patent Document 3: JP-A 2001-351563

SUMMARY OF THE INVENTION

Problem to be Solved by the Invention

The present invention has been developed in view of the previously described problems, and one objective thereof is to provide an atmospheric pressure ionization mass spectrometer capable of improving the sensitivity by increasing the amount of fragment ions in the case of the in-source CID, while preventing the formation of cluster ions which causes a background noise in a chromatogram or the like.

Means for Solving the Problems

In the atmospheric pressure ionization mass spectrometers having a multi-stage differential pumping system, the formation of cluster ions and the creation of fragment ions by the in-source CID within the intermediate vacuum chamber, which is provided next to the ionization chamber maintained at substantially atmospheric pressure, have conventionally been understood from a macroscopic point of view focused on the entire intermediate vacuum chamber. By contrast, the inventors of the present patent application have paid attention to the behavior of the ions within smaller areas inside the intermediate vacuum chamber, and have experimentally found that the area where the cluster ions are dominantly formed differs from the area where the fragment ions are dominantly created.

More specifically, it has been found that the main area where the cluster ions are formed is located between the exit end of an introduction part for introducing ions (which are normally mixed with micro-sized droplets) from the ionization chamber into the next intermediate vacuum chamber and the ion transport optical system (e.g. the aforementioned ion guide), whereas the main area where the fragment ions are created by CID is located between the ion transport optical system and the entrance end of an introduction part for introducing ions from the first-stage intermediate vacuum chamber into the second one. The spatial separation of two areas, i.e. the area where the cluster ions are formed and the area where the fragment ions are created, allows an independent control of the creation capabilities of each type of ions even within the same intermediate vacuum chamber. This finding has formed the basis for the present invention.

The present invention aimed at solving the aforementioned problem is an atmospheric pressure ionization mass spectrometer having a multi-stage differential pumping system including one or more intermediate vacuum chambers between an ionization chamber for generating ions under atmospheric pressure and an analysis chamber for mass-separating and detecting the ions under high vacuum, wherein:

either a partition wall separating the ionization chamber and the neighboring first-stage intermediate vacuum chamber, or the exit end of an ion introduction part for making these two chambers communicate with each other, is used as a first electrode;

either a partition wall separating the first-stage intermediate vacuum chamber and either the second-stage intermediate vacuum chamber or an analysis chamber in the next stage, or the entrance end of an ion transport part for making these two chambers communicate with each other, is used as a second electrode; and an ion transport electrode for creating an electric field for transporting the ions while converging them is provided in the first-stage intermediate vacuum chamber, and the atmospheric pressure ionization mass spectrometer further including:

a) a first voltage setting section for setting voltages individually applied to the first electrode and the ion transport electrode, to adjust the direct-current potential difference between these two electrodes so that a smaller amount of cluster ions will be formed; and b) a second voltage setting section for setting voltages individually applied to the ion transport electrode and the second electrode, to adjust the direct-current potential difference between these two electrodes according to whether or not it is necessary to create fragment ions.

Examples of the ion introduction part and the ion transport part include a small diameter capillary, a small diameter pipe, and a skimmer having an orifice.

The ion transport electrode is typically an ion guide or ion lens for converging ions by a radio-frequency electric field, although there are many other variations. For example, it is possible to use a multi-pole ion guide (e.g. quadrupole or octapole) having a plurality of rod electrodes arranged so as to surround the ion-beam axis, or the virtual rod multi-pole ion guide described in Patent Documents 1-3 which is an improved version of the multi-pole ion guide. The ion-beam axis formed by the first electrode, the ion transport electrode and the second electrode does not need to be on a straight line: it may be deflected so as to remove neutral particles or the like. In the case of creating a radio-frequency electric field to converge ions, a radio-frequency voltage with a direct-current voltage superimposed thereon is applied to the ion transport electrode.

Basically, in the atmospheric pressure ionization mass spectrometer according to the present invention, the first voltage setting section applies appropriate direct-current voltages to the first electrode and the ion transport electrode, respectively, to create an ion-accelerating electric field in the space between the first electrode and the ion transport electrode. This electric field accelerates ions that have been introduced from the ionization chamber through the ion introduction part into the first-stage intermediate vacuum chamber maintained at a lower gas pressure, and thereby prevents the ions from easily forming a mass. Thus, the formation of cluster ions is suppressed. In this manner, the amount of cluster ions that can cause a background noise is reduced, so that the quality of the mass spectrum or chromatogram is improved.

When the in-source CID needs to be performed, the second voltage setting section applies appropriate direct-current voltages to the ion transport electrode and the second electrode, respectively, to create an ion-accelerating electric field in the space between the ion transport electrode and the second electrode. The ions converged by the ion transport electrode are accelerated by this electric field. The thus energized ions collide with the residual gas, to be efficiently dissociated into fragment ions. In this manner, the amount of fragment ions is increased, so that these ions can be detected with higher sensitivity.

The atmospheric pressure ionization mass spectrometer according to the present invention may be constructed so that a user (operator) can determine the voltages respectively applied to the first electrode, the ion transport electrode and the second electrode by using the result of an analysis of a standard sample or the like. It is also possible to provide the system with a regulating section for performing an analysis of a standard sample or the like, while sequentially selecting a plurality of voltage levels in a stepwise manner, and for automatically determining the optimal voltages based on the result of the analysis (such as the peak intensity at a specific mass-to-charge ratio).

Effect of the Invention

In the atmospheric pressure ionization mass spectrometer according to the present invention, when the in-source CID should not be performed, i.e. when the fragment ions are unwanted, it is possible to suppress the creation of the fragment ions to the lowest possible level, simultaneously with suppressing the formation of the cluster ions, so as to acquire a high-quality mass spectrum or chromatogram with a low background noise. As a result, the accuracy of the qualitative analysis will be improved. Furthermore, the mass spectrum will be simple and easy to analyze.

2Ba-2Bc are diagrams showing examples of the direct-current potentials on the ion-beam axis.

FIGS. 3A-3C are measured examples of total ion chromatograms obtained under different voltage-applying conditions.

FIGS. 4A-4C are measured examples of mass spectra obtained at a specific point in time under different voltage-applying conditions.

FIGS. 5A-5C are measured examples of mass spectra obtained at a specific point in time under different voltage-applying conditions.

BEST MODE FOR CARRYING OUT THE INVENTION

One embodiment of the atmospheric pressure ionization mass spectrometer according to the present invention is hereinafter described with reference to the attached drawings.

Figure 1:
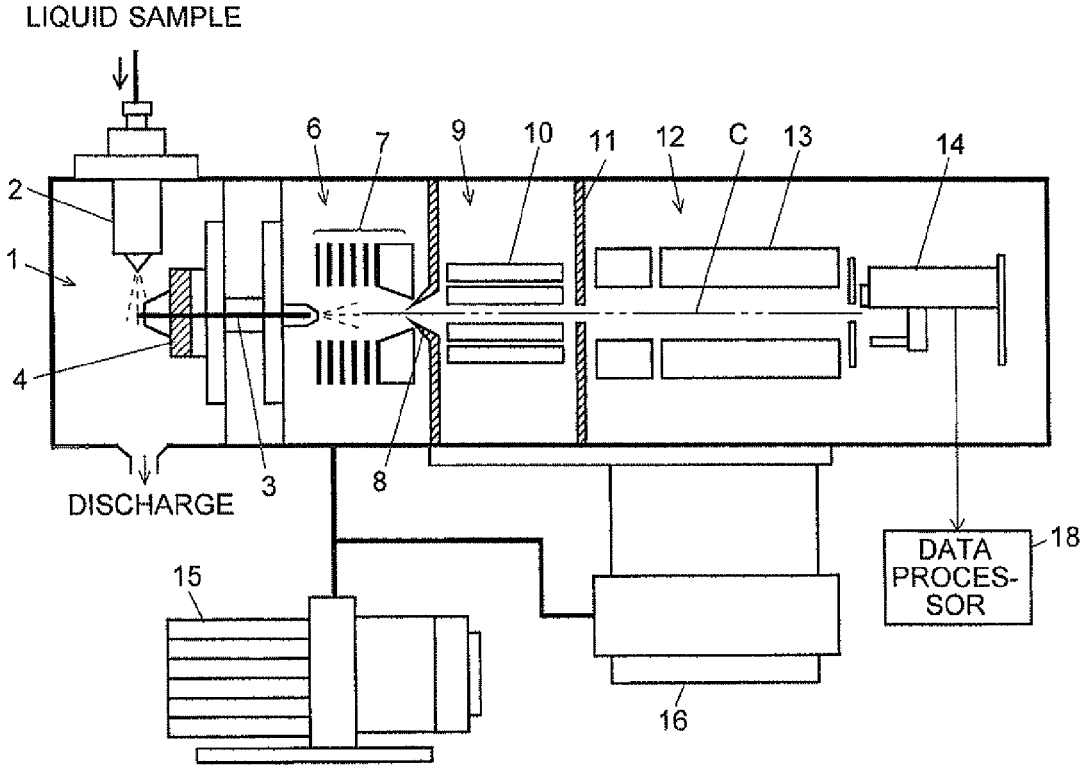
FIG. 1 is an overall configuration diagram of an atmospheric pressure ionization mass spectrometer as one embodiment of the present invention.
Figures 2A, 2B:
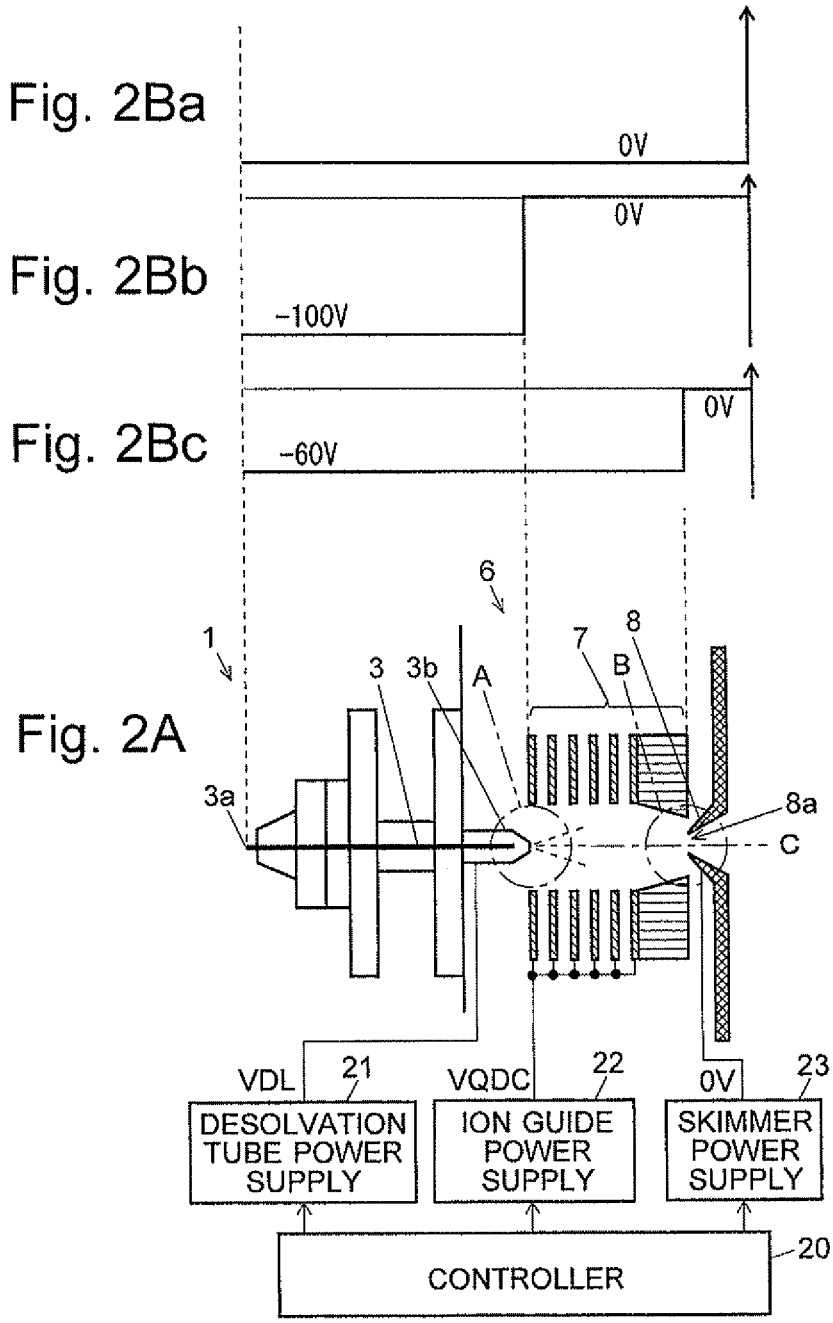
FIG. 2A is a detailed diagram mainly showing the first-stage intermediate vacuum chamber in FIG. 1, and FIGS.

FIG. 1 is a schematic configuration diagram showing the main components of the atmospheric pressure ionization mass spectrometer of the present embodiment. FIG. 2A is a detailed diagram mainly showing the first-stage intermediate vacuum chamber in FIG. 1.

The present mass spectrometer includes an ionization chamber 1 having a spray nozzle 2 to which a liquid sample is supplied from the exit end of the column of a liquid chromatograph (not shown), an analysis chamber 12 in which a quadrupole mass filter 13 and a detector 14 are provided, and two intermediate chambers 6 and 9 (the first-stage and second-stage intermediate vacuum chambers) each of which is separated by partition walls between the ionization chamber 1 and the analysis chamber 12. The ionization chamber 1 communicates with the first-stage intermediate vacuum chamber 6 through a small diameter desolvation tube (capillary) 3 warmed by a block heater 4. The first-stage intermediate vacuum chamber 6 communicates with the second-stage intermediate vacuum chamber 9 through a small-sized through hole (orifice) 8*a* bored at the apex of a skimmer 8. The first-stage intermediate vacuum chamber 6 contains a first ion guide 7 composed of a plurality of virtual rod electrodes arranged so as to surround an ion-beam axis C, each virtual rod electrode consisting of a plurality of plate electrodes arranged at intervals in the direction of the ion-beam axis C. The second-stage intermediate vacuum chamber 9 contains a second ion guide 10 consisting of a plurality of rod electrodes (e.g. eight rod electrodes) arranged so as to surround the ion-beam axis C, each rod electrode extending parallel to the ion-beam axis C.

The inner space of the ionization chamber 1 serving as the ion source is maintained at approximately atmospheric pressure (about $10^5$ [Pa]) due to the vaporous molecules of the solvent of a liquid sample continuously supplied from the spray nozzle 2. The first-stage intermediate vacuum chamber 6 is evacuated to a low vacuum of approximately $10^2$ [Pa] by a rotary pump 15, while the second-stage intermediate vacuum chamber 9 is evacuated to a medium vacuum of approximately $10^{-1}$ to $10^{-2}$ [Pa] by a turbo molecular pump 16. The analysis chamber 12 in the last stage is evacuated to a high vacuum state of approximately $10^{-3}$ to $10^{-4}$ [Pa] by another turbo molecular pump. That is to say, the pumping system adopted in the present mass spectrometer is a multi-stage differential pumping system in which the degree of vacuum is increased stepwise for each chamber from the ionization chamber 1 to the analysis chamber 12.

An operation of the mass spectrometry by the present atmospheric pressure ionization mass spectrometer is hereinafter schematically described.

A liquid sample is sprayed ("electro-sprayed") from the tip of the spray nozzle 2 into the ionization chamber 1, being given electric charges. In the process of the vaporization of the solvent in the droplets, the sample molecules are ionized. The cloud of ions, with the droplets mixed therein, are drawn into the desolvation tube 3 due to the pressure difference between the ionization chamber 1 and the first-stage intermediate vacuum chamber 6. Since the desolvation tube 3 is heated to high temperatures, the vaporization of the solvent is further promoted and more ions are generated while the droplets are passing through the desolvation tube 3.

The ions ejected from the exit end of the desolvation tube 3 into the first-stage intermediate vacuum chamber 6 are converged and transported by the effect of the radio-frequency electric field created by the radio-frequency voltage applied to the first ion guide 7, to be focused onto the vicinity of the orifice 8*a* of the skimmer 8 and efficiently pass through the orifice 8*a*. The ions introduced into the second-stage intermediate vacuum chamber 9 are converged and transported to the analysis chamber 12 by the second ion guide 10. In the analysis chamber 12, only a kind of ion having a specific mass-to-charge ratio corresponding to the voltage applied to the quadrupole mass filter 13 can pass through this filter 13. The other ions having different mass-to-charge ratios are dissipated only halfway. The ions that have passed through the quadrupole mass filter 13 arrive at the detector 14, which produces an ion-intensity signal corresponding to the amount of the ions and sends this signal to the data processor 18.

When the voltage applied to the quadrupole mass filter 13 is continuously varied over a predetermined range, the mass-to-charge ratio of the ions passing through this filter 13 correspondingly changes. The data processor 18 processes the data obtained along with this mass-scan operation to construct a mass spectrum. Furthermore, the data processor 18 processes the data obtained by repeating the mass-scan operation to construct a total ion chromatogram or mass chromatogram.

As shown in FIG. 2A, the entrance end 3*a* of the desolvation tube 3 is located in the ionization chamber 1, while its exit end 3*b* is located in the first-stage intermediate vacuum chamber 6. Due to the pressure difference between the two ends, the air inside the ionization chamber 1 continuously flows through the desolvation tube 3 into the first-stage intermediate vacuum chamber 6. The ions and sample droplets are carried by this air flow through the desolvation tube 3. Upon being ejected from the exit end 3*b* into the first-stage vacuum chamber 6, the ions and droplets are rapidly cooled. The cooled ions easily form cluster ions due to an adiabatic expansion. Since the cluster ions cause a background noise, their formation should be suppressed as much as possible. On the other hand, in the case of the in-source CID, in which an energized ion is made to collide with the air remaining in the first-stage intermediate vacuum chamber 6, it is necessary to make use of the considerable amount of residual air to produce a larger number of fragment ions by the dissociation of the original ion.

An effective method for reducing the cluster ions is to accelerate the ions by an electric field. However, as already explained, accelerating the ions makes them more energized, which increases the fragment ions even when no in-source CID is to be performed. This leads to undesirable results, such as an insufficient peak intensity of the ions of interest and/or an increased complexity of the mass spectrum. In the atmospheric pressure ionization mass spectrometer of the present embodiment, such problems are solved as follows:

The following descriptions deal with the results of measurements of a standard sample by the previously described system, with each measurement using a different setting of the voltages applied to the exit end 3*b* of the desolvation tube 3 (which corresponds to the first electrode in the present invention), the first ion guide 7 (which corresponds to the ion transport electrode in the present invention) and the skimmer 8 (which corresponds to the second electrode in the present invention). In these measurements, the same direct-current (DC) voltage was applied to the plate electrodes arranged at intervals along the ion-beam axis C and forming each of the virtual rod electrodes of the first ion guide 7. In addition to this DC voltage, a radio-frequency voltage was applied to each of the virtual rod electrodes of the first ion guide 7. However, the following descriptions take into account only the DC voltage.

FIGS. 3A-3C show actually measured total ion chromatograms (TICs) respectively obtained when the DC voltage $V_{DL}$ applied to the exit end 3*b* of the desolvation tube 3 and the DC voltage $V_{QDC}$ applied to the first ion guide 7 were set to ($V_{DL}$, $V_{QDC}$)=(0V, 0V), (−100V, 0V) and (−60V,−60V), with the voltage applied to the skimmer 8 maintained at 0V (ground potential). The sample was Erythromycin. The ionization mode was a negative ionization mode. It should be noted that the three TICs have the same scale on the horizontal axis (time axis) but different scales on the vertical axis (intensity axis). (The intensity scale of FIG. 3C is one tenth of those of FIGS. 3A and 38.)

In FIGS. 3B and 3C, there are four noticeable peaks, whereas, in FIG. 3A, the first peak is particularly indistinctive, and furthermore, the background noise is generally high. A comparison between FIGS. 3B and 3C demonstrates that the detection sensitivity of the four peaks in FIG. 3B is a few times higher. Accordingly, it can be said that the TIC of FIG. 3B has the highest quality, followed by FIGS. 3C and 3A.

FIGS. 4A-4C show actually measured mass spectra of the chromatogram peaks located at 1.81 minutes on the TICs shown in FIGS. 3A-3C. In each of FIGS. 4A-4C, the peak located at a mass-to-charge ratio of m/z 778 is the ion peak related to an objective molecule. In FIG. 3A, although this molecule-related ion peak is noticeable, a background ion peak originating from the dimer of formic acid is also observed at m/z 91. The mass spectrum shown in FIG. 4B, in which the molecule-related ion peak is noticeable, can be regarded as a high-quality mass spectrum. In FIG. 4C, the molecule-related ion peak is not noticeable; rather, many other peaks originating from fragment ions are present at m/z 732, 498 and so on, making the mass spectrum complex.

These results demonstrate that the qualities of the TICs shown in FIGS. 3A-3C depend on the amount of background noise and, under the conditions of FIG. 3B, the background noise has been so effectively removed that the high-quality TIC has been obtained.

FIGS. 5A-5C are mass spectra actually measured at 0.5 minutes on the TICs shown in FIGS. 3A-3B, i.e. at a point in time where no specific peak is observed. The peaks at m/z 45 and 91 are background ions originating from the monomer and dimer of formic acid, respectively. The background ion peak at m/z 91 is very high in FIG. 5A, while the same peak is eliminated in FIG. 5B. In FIG. 5C, both of the peaks at m/z 45 and 91 are weakened, which is probably due to the decomposition of the ions into fragment ions having even lower mass-to-charge ratios.

FIGS. 2Ba, 2Bb and 2Bc respectively show the DC potentials on the ion-beam axis under the aforementioned conditions of ($V_{DL}$, $V_{QDC}$)=(0V, 0V), (−100V, 0V) and (−60V,−60V).

When ($V_{DL}$, $V_{QDC}$)=(−100V, 0V), as shown in FIG. 2Bb, an electric field for accelerating negative ions is created in area A between the exit end 3*b* of the desolvation tube 3 and the entrance of the first ion guide 7, while no electric field is present in area B near the space between the exit of the first ion guide 7 and the skimmer 8. As already explained, under this condition, the background noise of the TIC is lowered, and no fragment peak appears on the mass spectrum.

When ($V_{DL}$, $V_{QDC}$)=(−60V, −60V), as shown in FIG. 2Bc, no electric field is present in area A, while an electric field for accelerating negative ions is created in area B. As already explained, under this condition, many fragment peaks appear on the mass spectrum.

When ($V_{DL}$, $V_{QDC}$)=(0V, 0V), as shown in FIG. 2Ba, no accelerating electric field is present in both areas A and B. Under this condition, although no fragment peak appears on the mass spectrum, the background noise of the TIC is high and the quality of the TIC is rather low.

The results of these measurements demonstrate that the cluster ions causing the background noise are dominantly formed in area A, and creating a DC electric field for accelerating the ions in area A is effective for suppressing the formation of cluster ions and thereby suppressing the background noise of TICs. On the other hand, the fragment ions resulting from the dissociation of the ions are dominantly formed in area B, and creating a DC electric field for accelerating the ions only in area B is effective for increasing the amount of fragment ions while suppressing the formation of cluster ions. Accordingly, when an analysis using the in-source CID is to be performed, i.e. when it is desirable to generate a large amount of fragment ions in the first-stage intermediate vacuum chamber 6, the voltages applied to the first ion guide 7 and the skimmer 8 can be set so as to create an accelerating electric field in area B. By contrast, as in the case of a normal analysis which does not use the in-source CID, when it is desirable to suppress the formation of cluster ions, the voltages applied to the desolvation tube 3 and the first ion guide 7 can be set so as to create an accelerating electric field in area A, without creating such an electric field in area B.

As shown in FIG. 2A, in the atmospheric pressure ionization mass spectrometer of the present embodiment, under the control of the controller 20, a skimmer power supply 23 applies a predetermined DC voltage to the skimmer 8, an ion guide power supply 22 applies another predetermined DC voltage to the first ion guide 7, and a desolvation tube power supply 21 applies still another predetermined DC voltage to the desolvation tube 3. For example, according to whether or not an in-source CID mode is selected as the analyzing mode, the controller 20 controls these power supplies 21, 22 and 23 so as to switch the voltage settings between the state in which an accelerating electric field is created in area A as shown in FIG. 2Bb and the state in which an accelerating electric field is created in area B as shown in FIG. 2Bc. The levels of the voltages applied to the desolvation tube 3, the first ion guide 7 and the skimmer 8 may be previously determined, although it is more preferable to provide the controller 20 with an adjustment function for automatically determining an optimal level for each voltage.

That is to say, when in the mode for automatic adjusting the analyzing condition, the controller 20 controls the power supplies 21, 22 and 23 so that a plurality of previously specified different levels of voltages are applied to each of the three components, i.e. the desolvation tube 3, the first ion guide 7 and the skimmer 8. Under each of the different combinations of the voltage levels, the controller 20 conducts a mass spectrometry of a standard sample and collects data. The data processor 18 examines, for example, the mass-to-charge ratio and intensity of each peak located on the mass spectrum to find the voltage condition under which the formation of cluster ions are most effectively suppressed, as well as the voltage condition under which the largest amount of fragment ions are generated. The controller 20 memorizes these voltage conditions in an internal memory. Then, according to whether or not the in-source CID mode is selected as the analyzing mode, it reads the better voltage condition from the internal memory to control the power supplies 21, 22 and 23. Accordingly, when the in-source CID mode is performed, a large amount of fragment ions are generated while the formation of the cluster ions is suppressed. When the in-source CID mode is not performed, both the formation of the cluster ions and the generation of the fragment ions are suppressed.

The descriptions thus far dealt with the case where the target of the analysis was a negative ion. It should be evidently understood that, in the case where the target of the analysis is a positive ion, an accelerating electric field for this ion can be created by reversing the polarities of the voltages applied to the desolvation tube 3, the first ion guide 7 and the skimmer 8.

It should be noted that the previous embodiment is a mere example of the present invention, and any change, modification or addition appropriately made within the spirit of the present invention will evidently fall within the scope of claims of the present patent application.

EXPLANATION OF NUMERALS

1 . . . Ionization Chamber
2 . . . Spray Nozzle
3 . . . Desolvation Tube
3*a*. . . Entrance End
3*b*. . . Exit End
4 . . . Block Heater
6 . . . First-Stage Intermediate Vacuum Chamber
7 . . . First Ion Guide
8 . . . Skimmer
8*a*. . . Orifice
9 . . . Second-Stage Intermediate Vacuum Chamber
10 . . . Second Ion Guide
12 . . . Analysis Chamber
13 . . . Quadrupole Mass Filter
14 . . . Detector
15 . . . Rotary Pump
16 . . . Turbo Molecular Pump
18 . . . Data Processor
20 . . . Controller
21 . . . Desolvation Tube Power Supply
22 . . . Ion Guide Power Supply
23 . . . Skimmer Power Supply
C . . . Ion-Beam Axis

The invention claimed is:

1. An atmospheric pressure ionization mass spectrometer having a multi-stage differential pumping system including one or more intermediate vacuum chambers between an ionization chamber for generating ions under atmospheric pressure and an analysis chamber for mass-separating and detecting the ions under high vacuum, wherein:

either a partition wall separating the ionization chamber and a neighboring first-stage intermediate vacuum chamber, or an exit end of an ion introduction part for making these two chambers communicate with each other, is used as a first electrode;

either a partition wall separating the first-stage intermediate vacuum chamber and either a second-stage intermediate vacuum chamber or an analysis chamber in a next stage, or an entrance end of an ion transport part for making these two chambers communicate with each other, is used as a second electrode; and an ion transport electrode for creating an electric field for transporting the ions while converging them is provided in the first-stage intermediate vacuum chamber, and the atmospheric pressure ionization mass spectrometer further comprising:

a) a first voltage setting section for setting voltages individually applied to the first electrode and the ion transport electrode, to adjust a direct-current potential difference between these two electrodes so that a smaller amount of cluster ions will be formed; and b) a second voltage setting section for setting voltages individually applied to the ion transport electrode and the second electrode, to adjust a direct-current potential difference between these two electrodes according to whether or not it is necessary to create fragment ions.

2. The atmospheric pressure ionization mass spectrometer according to claim 1, wherein the ion introduction part is a small diameter capillary.

3. The atmospheric pressure ionization mass spectrometer according to claim 1, wherein the ion introduction part is a skimmer having an orifice.

4. The atmospheric pressure ionization mass spectrometer according to claim 1, wherein the ion transport electrode is an ion guide for converging ions by a radio-frequency electric field.

5. The atmospheric pressure ionization mass spectrometer according to claim 1, wherein the first voltage setting section applies predetermined direct-current voltages to the first electrode and the ion transport electrode, respectively, to create an ion-accelerating electric field in a space between the first electrode and the ion transport electrode.

6. The atmospheric pressure ionization mass spectrometer according to claim 1, wherein, when the in-source CID is performed, the second voltage selling section applies appropriate predetermined direct-current voltages to the ion transport electrode and the second electrode, respectively, to create an ion-accelerating electric field in a space between the ion transport electrode and the second electrode.

7. The atmospheric pressure ionization mass spectrometer according to claim 1, further comprising a regulating section for performing an analysis of a predetermined sample, while sequentially selecting a plurality of voltage levels in a stepwise manner, and for automatically determining optimal voltages based on a result of the analysis.

* * * * *